United States Patent [19]

Hosterman et al.

[11] 4,157,015

[45] Jun. 5, 1979

[54] HYDRAULIC REFRIGERATION SYSTEM AND METHOD

[75] Inventors: Craig Hosterman, Scottsdale; Warren Rice, Tempe, both of Ariz.

[73] Assignee: Natural Energy Systems, Tempe, Ariz.

[21] Appl. No.: 862,119

[22] Filed: Dec. 19, 1977

[51] Int. Cl.[2] ..... F25B 1/00; F25D 15/00; F25B 1/06

[52] U.S. Cl. ..... 62/115; 62/119; 62/500

[58] Field of Search ..... 62/115, 116, 119, 122, 62/260, 498, 500, 514 R, 467 R; 126/400

[56] References Cited

U.S. PATENT DOCUMENTS

| | | | |
|---|---|---|---|
| 1,882,256 | 10/1932 | Randel | 62/500 |
| 2,152,663 | 4/1939 | Randel | 62/500 |
| 2,191,864 | 2/1940 | Schaefer | 62/119 |
| 3,789,617 | 2/1974 | Rannow | 62/115 |
| 3,848,424 | 11/1974 | Rhea | 62/115 |

*Primary Examiner*—Lloyd L. King
*Attorney, Agent, or Firm*—Cahill, Sutton & Thomas

[57] ABSTRACT

A refrigerant fluid is entrained within a down pipe of a closed loop water flow circuit to compress the refrigerant fluid from a gaseous state to a liquid state. A separation chamber at the lower extremity of the down pipe separates the liquid refrigerant fluid from the water and the water is drawn off. The water flows upwardly through a return pipe and pump, through a pipe for reintroduction to the down pipe at the lower end thereof. The drawn off liquid refrigerant flows upwardly through a return pipe and through an expansion valve. The refrigerant fluid, converted to a mixture of vapor and liquid, called a "quality mixture of the refrigerant" by the expansion valve, flows through an evaporator to cool a medium, such as air, passing therethrough. The refrigerant fluid, flowing from the evaporator and in a gaseous state at a higher temperature, is introduced to the upper end of the down pipe for reentrainment in the water flowing into the down pipe.

18 Claims, 5 Drawing Figures

HYDRAULIC REFRIGERATION SYSTEM AND METHOD

The present invention relates to refrigeration systems and, more particularly, to refrigeration systems which do not require mechanical compressors to compress or convential condenser to condense the refrigerant fluid.

The principle of entrapping and compressing air by movement of water, i.e. using a hydraulic air compressor or "trompe", as it is called, has been employed industrially in the United States for some years. In one such installation, air is drawn into a down flowing stream of water and trapped within a cavernous underground chamber where the head of water maintains it under compression. The air is permitted to escape through a pneumatic engine or turbine; thus, power may be generated.

Various proposals have been made in the prior art to use the abundant wave energy of the sea for producing power. Because of the potential power available from the ocean, many ingenious suggestions have been made for harnessing some of the power. Among such suggestions are some that include generation of electricity, as described in U.S. Pat. No. 3,064,137. Therein, it is suggested that the energy of the ocean waves be used to cyclically feed a down pipe and entrap a column of air. The column is replenished and repressurized from wave to wave. The compressed air is finally expanded through a turbine driving an electrical generator to produce electrical energy storable in a battery. U.S. Pat. No. 3,754,147, describes a related system wherein the electricity generated is employed for electrolysis purposes.

In refrigeration systems, the major operating costs arise from the costs attendant energization of a mechanical compressor to compress the refrigerant. Additionally, the cost of such a compressor is a substantial part of the initial cost of the refrigeration system itself. Thus, it would be beneficial from the standpoint of both initial and operating costs to eliminate the need for a mechanical compressor in a refrigeration system.

The present invention is directed to a refrigeration system which employs the principles of operation of a "trompe" system for effecting the necessary compression of the refrigerant fluid. To provide the requisite head to the water and effect compression of the refrigerant fluid, a pump is employed. While the initial and operating costs of such a pump are not insignificant, these costs are substantially less than the cost associated with a compressor. Thereby, the major costs attendant refrigeration systems are substantially reduced by the present invention.

It is therefore a primary object of the present invention to eliminate the need for a mechanical compressor in a refrigeration system.

Another object of the present invention is to provide an inexpensive refrigeration system.

Yet another object of the present invention is to provide a hydraulic flow system for compressing the refrigerant fluid of a refrigeration system.

Still another object of the present invention is to provide a refrigeration system having a closed loop water system for compressing the refrigeration fluid of a closed loop refrigeration system.

A further object of the present invention is to provide a means for entraining a refrigerant fluid within a downward flow of water to effect compression and condensation of the refrigerant fluid.

A yet further object of the present invention is to provide a means for compressing and condensing the refrigerant fluid of a refrigeration system by entraining the refrigerant fluid within a downward flow of water, compressing the refrigerant fluid and separating the compressed refrigerant fluid from the water.

These and other objects of the present invention will become apparent to those skilled in the art as the description thereof proceeds.

The present invention may be described with greater specificity and clarity with reference to the following drawings, in which.

Figure 1:
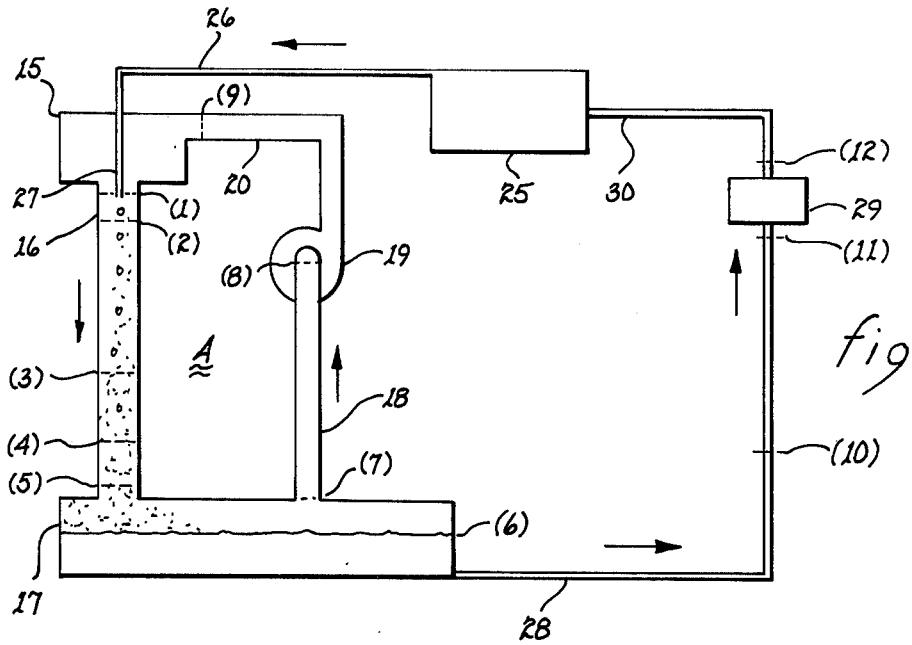
FIG. 1 is a schematic diagram of the hydraulic refrigeration system.

Referring to FIG. 1, there is shown a hydraulic refrigeration system divisible into two coacting interrelated subsystems, a water system A and a refrigeration system B. The water system includes a plenum 15 in fluid communication with the upper end of a down pipe 16. The lower end of the down pipe feeds a separation chamber 17. This chamber may be rectangular, as shown, hopper shaped or trough shaped. A return pipe 18 extends upwardly from the separation chamber and serves as a water conduit to a water pump 19. The output from the water pump is transmitted through pipe 20 into plenum 15.

Hydraulic refrigeration system B includes an evaporator 25 in which the cooled refrigerant fluid absorbs heat from a medium to be cooled (such as air) passing therethrough. The refrigerant fluid flowing out of the evaporator and through pipe 26 is in a gaseous state and generally superheated. Outlet 27 of pipe 26 is disposed in proximity to the inlet to down pipe 16. For reasons which will be discussed in further detail below, the gaseous refrigerant fluid discharged through outlet 27 will become entrained within the water flowing downwardly therepast into and through down pipe 16. Thereby the refrigerant fluid is conveyed to separation chamber 17. Within the separation chamber, the refrigerant fluid, being in a liquid state and more dense than water, will tend to settle at the bottom of the separation chamber. Because of the pressure present within separation chamber 17, induced by the head of the water in down pipe 16, the refrigerant fluid, in a liquid state, is forced through pipe 28 and into expansion valve 29. The term "pressure" as related to the "head of water" is in fact substantially more complex. The true or actual pressure is related to the head of water and bubbles and to dynamic conditions. However, as there is no simple way to make a correct statement without mathematical analysis, the terms, as used above, will be used for reasons of simplicity. The refrigerant fluid approaching the expansion valve is partly vapor and mostly liquid, called "low quality mixture state". After the expansion valve, the amount of vapor has increased, the amount of liquid has decreased (and the temperature has decreased) and it is called an "increased quality mixture state". The pressure after the expansion valve is not necessarily low, although it is the lowest pressure in the system. It is the pressure corresponding with the desired temperature in the evaporator in the "saturation property tables" for whatever refrigerant is in use, as is well known. The cooled refrigerant fluid flows from expansion valve 29 through pipe 30 into the inlet of evaporator 25.

From the above description, it will become apparent that water system A is a simple closed loop system for developing a downward flow through down pipe 16 and a pressure within separation chamber 17 commensurate with the head of the column of water. Refrigeration system B includes a conventional expansion valve 30 and evaporator 25. The function performed by conventional condensers and compressors are achieved by down pipe 16 and separation chamber 17, as will be described in detail below.

The refrigerant fluid, hereinafter referred to by the term "freon", is in a superheated gaseous state at the point of discharge through outlet 27. On discharge, the freon is injected into the water within down pipe 16 in the form of bubbles. These bubbles become entrained within the downward flow of water in proximity to outlet 27. Necessarily, these bubbles shortly acquire the same temperature and pressure as the surrounding water. These bubbles are carried downwardly by the water due to their entrainment therein. The bubbles have an upward drift velocity relative to the water, which drift is at a lower velocity than the downward water flow velocity. Continuing downward movement of the bubbles results in a pressure increase commensurate with the depth or head of water at any given location. At some location along down pipe 16, represented by numeral (3), the ambient pressure corresponds with the saturation pressure for the freon at the there existing temperature. Accordingly, the freon will undergo a change of state from gas to liquid. The change of state or condensation process is heat transfer rate controlled through the absorbtion of heat by the surrounding water and a quiescent temperature is achieved at location (4). At location (5), all of the freon is in the state of liquid droplets dispersed within the water, which droplets are at the same temperature as the water and more dense than the water. Consequently, the drift velocity of the freon is now downward relative to the water flow velocity.

The mixture of liquid freon and water enters separation chamber 17. Herein, the flow is stilled to some extent with or without the use of baffle means and a flow direction change occurs. The combination of flow stilling and flow direction change tends to encourage separation of the liquid freon and water such that the freon will gravitate to the bottom of the chamber. The water is drawn from chamber 17 by pump 19 through pipe 18 and ultimately conveyed into plenum 15. The vertical location of pump 19 is selected so as to prevent pump inlet cavitation.

The liquid freon within separation chamber 17 is expelled therefrom into pipe 28 due to the pressure head created primarily by the water in down pipe 16. As the liquid freon moves upwardly through pipe 28 to expansion valve 29, the pressure decreases until the liquid freon begins to vaporize at location (10). At the inlet to expansion valve 29, the freon is at a low quality mixture state but at a pressure greater than the pressure within evaporator 25. Therefore, expansion valve 29, disposed in the path of the freon, reduces the pressure and temperature thereof to a value commensurate with that desired in the evaporator. Within the evaporator, freon, entering as a quality mixture, absorbs heat from the medium passing therethrough and the freon becomes at least slightly superheated vapor.

Since heat is continually transferred from the freon within down pipe 16 to the surrounding water, the temperature of the water will rise unless the heat can be transferred to a heat sink. The requisite heat sink may be provided by the earth surrounding water system A in the event the latter is buried within the ground; alternatively, cooling fins may be employed to transfer heat to the ambient air. Other forms of heat sinks are well known and may also be incorporated.

The hydraulic refrigeration system may be considered a cycle-type refrigeration system in the conventional thermodynamic sense. That is, work is added to the cycle by the pump, heat is rejected from the cycle by the down pipe to the surrounding earth or other heat exchanger and heat is added to the cycle at the evaporator. Accordingly, the cycle described is in accord with the second law of thermodynamics from both the qualitative and quantitative standpoint.

In analyzing the present invention from the thermodynamic standpoint, several observations may be made. The compression and heat rejection phases of a refrigeration system are simultaneously performed in the down pipe. The water pump is the only moving part of the system. More recovery of work is achieved as the freon returns to the evaporator then in conventional refrigeration systems because there is less irreversible throttling at the expansion value. Compression of the freon is virtually isothermal at the water temperature, which is the preferred compression process and superior to the irreversible adiabatic process performed by a conventional freon compressor. Finally, the earth or ground is useable as a heat sink.

It is not possible to arbitrarily choose the thermodynamic conditions to be achieved at the various locations within the refrigeration system and thereafter calculate the performance of the system. Instead, one must choose the temperature preferred at the evaporator and the amount of refrigeration wanted; thereafter, all other parameters of the system are determinable by calculation to assure satisfaction of the first law of thermodynamics, the law of conservation of momentum and the law of conservation of mass.

In the following analysis, the equations are statements of satisfaction of the above identified laws and all of the equations together constitute a mathematical model of the hydraulic refrigeration system. Various idealizations are necessarily incorporated into such a model and may be slight departures from reality. The primary idealization in the following mathematical analysis is one-dimensionality of the flow.

In the following analysis, various symbology is used and a legend therefore appears below:

Nomenclature subscripts

F—freon
l—liquid (water)

numbers→stations shown in schematic diagram

P—pump
u—water return pipe
d—down pipe
t—freon supply pipe at station 1
f—liquid phase of freon fg—latent value for evaporation of freon
R—reference value
r—relative to water velocity
B—buoyant
D—drag
REF—refrigeration alphabetic A—cross-sectional area
Cd—drag coefficient
d—differential operator
D—droplet diameter
F—force
g—gravitational constant
$h_{LETTER}$—enthalpy
$h_{NUMBER}$—vertical distance
$\dot{Q}_{REF}$—refrigeration
$K_{NUMBERS}$—entrance loss coefficient or pressure recovery coefficient
$\dot{m}$—mass flow rate
P—pressure
S—circumference
T—temperatures
v—specific volume
V—velocity
x—quality
z—coordinate foreign and/or special COP—coefficient of performance
Δ—difference operator
f—fluid friction factor
L—density
u—viscosity It is to be understood that while freon and water are a likely combination for use in a hydraulic refrigeration system, any other combination of carrier and refrigerant fluid that is not miscible could be used; in example, butane and water.

Mathematical modeling of the invention results in equations which must be solved simultaneously using a digital computer. The programming of the equations is such that all dimensions, pressures, temperatures, pump power, cycle performance, etc., are calculated automatically when the program is supplied with the freon designation, evaporator temperature and desired tonnage of refrigeration.

Figure 2:
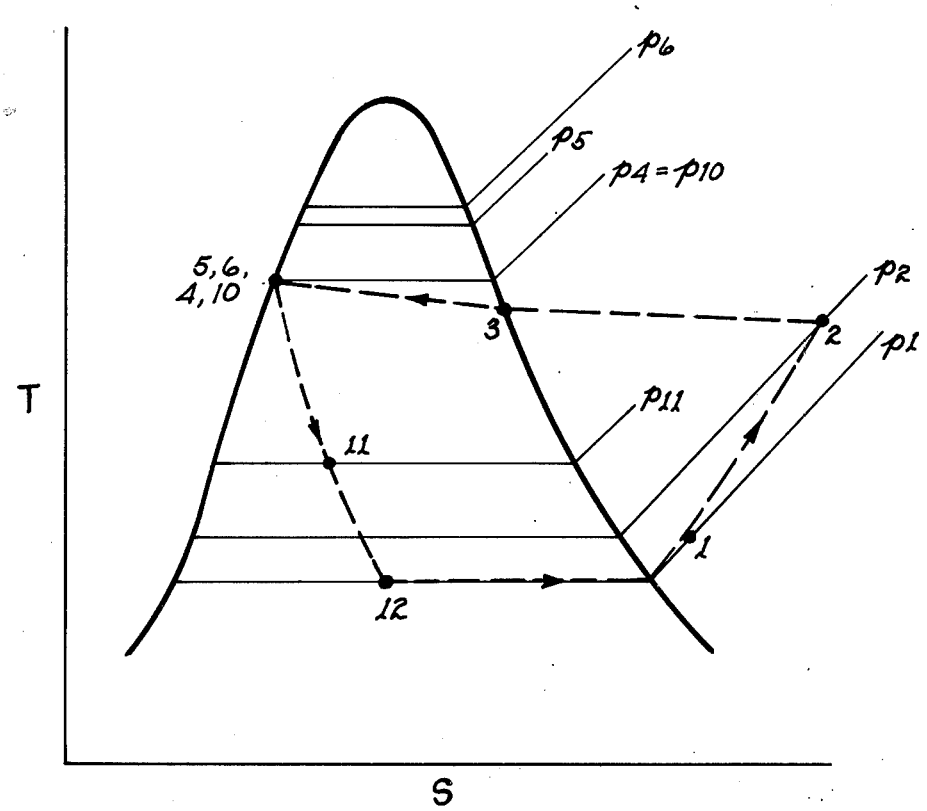
FIG. 2 is a thermodynamic state diagram representative of the hydraulic refrigeration system.

Mathematical modeling of the invention follows:

In addition to the above legend, numerals (0), (1), (2), (3), (4), (5), (6), (7), (8), (9), (10), (11), and (12) will be used to correlate the equations with locations upon the structure illustrated in FIG. 1 and the thermodynamic state diagram illustrated in FIG. 2.

Flow of l phase from (0)→(1) in downpipe just before entrainment of F phase $$\frac{P_o}{\phi_l} + gH_{o1} = \frac{P_{l1}}{\phi_l} + \frac{V_{l1}^2}{2} + K_{o1}\left(\frac{V_{l1}^2}{2}\right) \quad (1)$$

where $h_{01} > O$ and $K_{01}$ is inlet loss coefficient for l phase at entrance to down pipe. (1) is the hydraulic form of energy conservation and momentum conservation (together). The conservation of mass equation is $$\dot{M}_l = \phi_e(A_d - A_l)V_{ll} \quad (2)$$

Entrainment process (1)→(2)

The flow is assumed isothermal. It is also assumed that $P_{l2} = P_{F2} = P_2$ and $T_{l2} = T_{F2} = T_1 = T_2$. The momentum conservation equation is $$P_{F1}A_l + P_{l1}(A_d - A_l) - P_2A_d = \dot{M}_lV_{l2} + \dot{M}_F(V_{l2} - V_{R2}) - \dot{M}_lV_{l1} - \dot{M}_FV_{F1} \quad (3)$$

The mass conservation equation is $$\dot{M}_F = \phi_{F2}(V_{l2} - V_{r2})\left(Ad - \frac{\dot{M}_l}{\phi_E V_{l2}}\right) \quad (4)$$

which is a combination of the conservation equations for the separate phases. In process (1)→(2), no energy equation (conservation of energy) is needed because the isothermal assumption is effectively a solution of the equation. In the computerized solution of the flow for process (2), equations (3) and (4) are solved simultaneously, iteratively, using freon properties from functional subroutines supplied by the freon vendor.

Flow in down pipe below gas entrainment zone, while vapor is superheated, (2)→(3)

Figure 3:
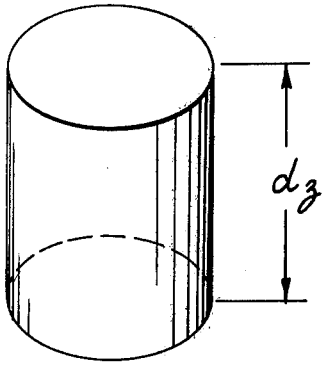
FIG. 3 is an illustration of a mathematical dimension.

The flow is treated as isothermal which eliminates the need for an explicit use of the equation of conservation of energy. An element of the downward flow is considered; in the computerized implementation of the analysis, the resulting finite difference equations are solved step wise, serially from (2)→(3). The computer program stops the process and gives the location of (3) when the pressure reaches the saturation pressure of freon at the water (and freon) temperature. It is asumed that $P_l = P_F = P$ and $T_l = T_F = T$ at any depth. $d_z > 0$, (See FIG. 3), $g > 0$ and $z > 0$ downward. The equation for conservation of momentum is $$pAd - (p + dp)Ad + \phi_F A_F g dz + \phi_l A_l g dz - \frac{f\phi_l V_l^2 S_d dz}{8} = \dot{M}_l(V_l + dV_l - V_l) + \dot{M}_F[(V_l - V_r) + d(V_l - V_r) - (V_l - V_r)] \quad (5)$$

and using the flow rate equations, $\dot{M} = \phi_l A_l V_l$ and $\dot{M}_F = \phi_F A_F(V_l - V_r)$ and $A_F + A_l = A_d$ and neglecting terms that are linear in $dV_r$, equation (5) becomes $$dpAd - \left[\frac{\dot{M}_l}{V_l} + \frac{\dot{M}_F}{(V_l - V_r)}\right]gdz + \frac{f\phi V_l^2 S_d dz}{8} + (\dot{M}_l + \dot{M}_F)dV_l = 0 \quad (6)$$

The equation for conservation of mass, with the same idealizations, becomes $$dV_l = -\frac{d\phi_F}{\phi_f} \frac{(V_l - V_r)\left(1 - \frac{\dot{M}_l}{\phi_l V_l Ad}\right)}{\left(1 - \frac{\dot{M}_l V_r}{\phi_l V_l^2 Ad}\right)} \quad (7)$$

It is necessary to solve equations (6) and (7) iteratively, using freon properties from the vendor-supplied subroutines, at every step of the step wise solution from (2)→(3). It is noted that fluid friction is fully accounted for by use of the friction factor f. Since f is a function of pipe roughness and local Reynolds number, these items are used locally in an iterative manner in the computerized solution.

It is assumed that freon bubbles drift upward relative to the water at a drift velocity which depends on relative density difference between water and freon and on bubble size. It is assumed (idealized) that all bubbles are the same size and density at a given depth and that bubble size and density vary with depth; thus, the changing bubble velocity relative to the water is accounted for in the modeling. The details of this feature follow. The bubble is in equilibrium under the action of a buoyant force and a fluid-mechanical drag force:

$$F_8 = (\phi_l - \phi_F)g\pi D^3/6$$

$$F_D = \frac{C_D\phi_l D^2 V_r^2 \pi}{8}$$

$$C_D = \frac{24\mu_l}{\phi_l V_r D}$$

and at equilibrium conditions, these result in $$V_r = \frac{(\phi_l - \phi_F)gD^3}{18\mu_l} \tag{8}$$

The reference condition R is introduced; some imperical information must be used at the reference state. In the computer program, the fact that $V_{rR-=0.8}$ ft/sec., as shown from experiment, is the reference state knowledge introduced. Since the mass of each bubble is conserved during its downward travel $$\frac{\pi\phi_f D^3}{6} = \frac{\pi\phi_{FR}D_R^3}{6}$$

which results in $$D^2 = \frac{18V_{rR}\mu_l}{(\phi_l - \phi_{FR})g}\left(\frac{\phi_{FR}}{\phi_F}\right)^{2/3}$$

which when entered into equation (8) gives $$V_r\, V_{rR}\left(\frac{\phi_l - \phi_F}{\phi_l - \phi_{FR}}\right)\left(\frac{\phi_{FR}}{\phi_F}\right)^{2/3} \tag{9}$$

This describes how the local $V_r$ changes from the reference value of $V_r$ due to changes in diameter and density of the freon bubbles as they travel downward.

At state (3) the freon bubbles are saturated vapor condition.

Flow in down pipe; from the location at which freon is saturated vapor to the location at which it is saturated liquid (3)→(4)

Flow is assumed isothermal, thus satisfying the law of conservation of energy. It is also assumed that $P_{l3}=P_{F3}=P_3$ and $T_{l3}=T_{F3}=T_3$ and $P_{l4}=P_{F4}=P_4$ and $T_{l4}=T_{F4}=T_3=T_4$. It is assumed that $\phi_{F4}$ is a function of T only. The equation for conservation of momentum is $$P_3A_d - P_4A_d + L_lAdgh_{34} = \dot{M}_l(V_{l4}-V_{l3}) + \dot{M}_F[(V_{l4}-V_{r4})-(V_{l3}-V_{r3})] \tag{10}$$

and the equation for conservation of mass is $$\dot{M}_F - \phi_{F4}(V_{l4} - V_{r4})\left(Ad - \frac{\dot{M}_l}{\phi_l V_{l4}}\right) \tag{11}$$

These can be (and are in the computer program) solved simultaneously for conditons at state (4), in closed form (but still under the isothermal assumption).

Most of the heat that is transferred from the freon to the water is transferred during the freon condensation (3)→(4). Using the law of conservation of energy in approximate form, the temperature of the water at (4) is given by $$T_4 = T_3 + \frac{\dot{M}_F h_{FG} \text{ at } T_3}{M_l C_{vl}} \tag{12}$$

Flow in down pipe after the F phase is liquid (4)→(5)

The freon is subcooled in this process, but no thermodynamic data for subcooled freon is existent. Therefore, the flow is considered as incompressible. It is assumed that $P_l=P_F=P$ and $T_l=T_FT$, $V_{l4}=V_{l5}$ and $V_{F4}=V_{F5}$. Since the hydraulic (incompressible) assumption reduces the law of conservation of energy and law of conservation of momentum to the same expression, it is $$\dot{M}_l\left(\frac{V_{l4}^2}{2} + gh_{45} + \frac{P_4}{\phi_l}\right) + \dot{M}_F\left(\frac{V_{F4}^2}{2} + gh_{45} + \frac{P_4}{\phi_{F4}}\right) = \dot{M}_l\left(\frac{V_{l5}^2}{2} + O + \frac{P_5}{\phi_l}\right) + \dot{M}_F\left(\frac{V_{F5}^2}{2} + O + \frac{P_5}{\phi_{F5}}\right) + \dot{M}_l\left(\frac{fV_l^2\phi_l h_{45}}{2D_o}\right) \tag{13}$$

Clearly fluid friction is accounted for by the use of f as a function of the local Reynolds number. In the computer program, equation (13) is solved together with the equation of conservation of mass, to get $P_5$, $V_{l5}$ and $V_{F5}$.

Exiting of mixture from downpipe and separation of the freon phase (5)→(6)

There is a 'pressure recovery coefficient', $K_{56}$. It is assumed that the separation chamber is large enough that fluid friction for the motion through the chamber can be neglected; thus, the freon-water interface is a horizontal line. For $h_{56}>O$ when (6) is below (5) and for incompressible flow, the conservation of energy equation (which is also the conservation of momentum equation) is $$\dot{M}_l\left(\frac{P_5}{\phi_l}+\frac{V_{l5}^2}{2}+gh_{56}\right)+\dot{M}_F\left[\frac{P_5}{\phi_F}+\frac{(V_{l5}-V_{r5})^2}{2}+gh_{56}=\dot{M}_l\left(\frac{P_6}{\phi_l}+O+O\right)+\dot{M}_F\left(\frac{P_6}{\phi_F}+O+O\right)+(1-K_{56})\dot{M}_l\frac{V_{l5}^2}{2}-(1-K_{56})\dot{M}_F\frac{(V_{l5}-V_{r5})^2}{2}\right. \quad (14)$$

In implementation of this equation, together with the law of conservation of mass equation (5)→(6), all terms due to the F phase were dropped since they are very small compared with those due to the l phase. Thus the equations used were $$P_6=P_5+\phi_l gh_{56}+\phi_l K_{56}\frac{V_{l5}^2}{2} \quad (15)$$

and $$V_6=0$$

Flow of l phase from separation tank into lower end of water return pipe, (6)→(7)

In the water return pipe, the velocity is constant and is given by equation of conservation of mass as $$V_7=\dot{M}_l/\phi_l A_u \quad (16)$$

The equation of conservation of energy (or momentum, since water is incompressible) is $$P_7=P_6-Lgh_{67}-L(1+K_{67})V_7^2/2$$

where $h_{67}>O$ for (7) above (6) and where $K_{67}$ is an entrance loss coefficient.

Flow of l phase in water return pipe to pump inlet, (7)→(8)

The fluid is incompressible, the Reynolds number and f are constant, the flow is isothermal. The applicable equations are $$\frac{P_7}{\phi_l}+\frac{V_7^2}{2}+O=\frac{P_8}{\phi_l}+\frac{V_8^2}{2}+\frac{f_{78}V_7^2h_{78}}{2D\mu}+gh_{78} \quad (17)$$

but $V_7=V_8$ if the pipe is of constant diameter. Also, $P_8$ is to be specified as a pressure large enough to prevent pump inlet cavitation (say, atmospheric pressure). To compute the pump inlet location within the program, the proper equation is $$h_{78}=\frac{1}{\phi_l}\left(\frac{P_7-P_8}{\frac{f_{78}V_7^2}{2D\mu}+g}\right) \quad (18)$$

Flow in the water return pipe from pump inlet to (0) in the plenum (8)→(9)→(0)

The pressure recovery factor at the pipe exit (into the plenum) is $K_{89}\cdot K_{89}>O$. We assume a pressure increase across the pump of $\Delta P_p$ is assumed. Then, since the fluid is incompressible, the conservation of energy equation (or momentum) is $$\frac{P_8}{\phi_l}+\frac{V_8^2}{2}+O=\frac{P_9}{\phi}+\frac{V_q^2}{2}+gh_{89}+\frac{f_{89}V_8^2h_{89}}{2D\mu}-\frac{\Delta P_p}{\phi_l}-K_{89}\frac{V_8^2}{2} \quad (19)$$

In the computerized calculations, this is solved for $\Delta P_p$, using $V_8V_9$.

Flow of freon in freon return pipe (6)→(10)

The freon is in a thermodynamic subcooled state in this flow, but is considered as an imcompressible fluid since no subcooled property data exists. The applicable conservation equations are $$\dot{M}_F=\phi_F A_{FR}V_{10} \quad (20)$$

and $$\frac{p^6}{\phi_F}+O+O=\frac{p^{10}}{\phi_F}+\frac{V_{10}^2}{2}=gh_{610}+\frac{f_{610}h_{610}V_{10}^2}{2D_{FR}} \quad (21)$$

and are solved for $h_{610}$ after assuming a reasonable velocity for the freon; the freon return pipe size is also calculated. $p_{10}$ is known; it is the saturation pressure for freon at the water (and freon) temperature in the separation chamber.

Flow in freon return pipe while freon is flowing upward and boiling, (10)→(11)

Figure 4:
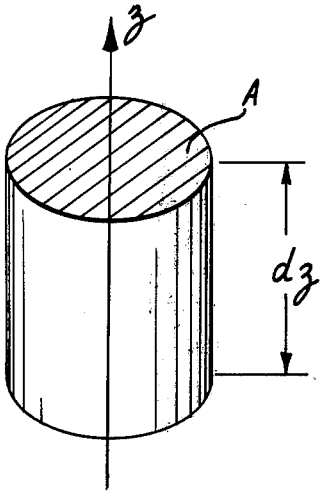
FIG. 4 is an illustration of mathematical dimensions.

A step wise solution of finite difference equations is used; the equations are in satisfaction of conservation of energy, conservation of momentum, and conservation of mass laws applied to an element of length dz (see FIG. 4):

$$\frac{dp}{\phi F}+gdz+V_F dV_F+\frac{fV_F^2S_F dz}{8A_{FR}}=O \quad (22)$$

$$dh_F+V_F dV_F+gdz=O \quad (23)$$

In the above equations, $h_F$ is the freon enthalpy, and $$dV_F/V_F=dv_F/v_F$$

These are solved, using property data from subroutines provided by the freon vendor, in an iterative manner at each step of the step wise procedure. Relative (drift) velocity of the freon bubbles is ignored.

With each 'step' up the pipe, the pressure decreases, some freon evaporates to vapor from (that is, the freon quality x increases) and the temperature decreases. At the conclusion of iterations at each forward step, the freon quality is calculated using the energy equation:

$$X_F\left(h_{Ff_g}+\frac{V_z^2v_{fg}}{v_z}\right)=h_{Fz}-h_{Ff}-gdz-V_z^2\left(\frac{v_f-v_z}{v_z}\right) \quad (24)$$

where sub z denotes values at the end of the step.

Expansion valve flow (throttle), (11)→(12)

Kinetic energy change is neglected and potential energy change is neglected. Hence, the applicable equation is $$h_{F11}=h_{F12}=hf_{F12}+x_{F12}hfg_{12}$$

This is used to solve for $x_{12}$. The temperature in the evaporator ($T_{12}$) being prescribed as input data, $P_{12}$ is known to be the corresponding saturation pressure for freon.

The above outline of the mathematical model indicates equations that are sufficient in the computer program to calculate all pressures, temperatures, energy states, velocities, flow rates, and pipe sizes throughout the system, for any specified freon type, refrigeration tonnage, and evaporator pressure (temperature). The computer program carries out the calculations and prints the results.

From the calculated state values, all interesting performance quantities can be calculated as follows.

Required pump power

Neglect changes in potential energy and kinetic energy and consider the water as incompressible. Then $$¶=\dot{M}(\Delta P_p/\phi_l) \quad (25)$$

Refrigeration obtained

Neglect changes in potential energy and kinetic energy and the energy equation applied to evaporator yields $$\dot{Q}_{RFF}=\dot{M}(h_{Fl}-h_{F12}) \quad (26)$$

where $$h_{F12}=hf_{F12}+x_{F12}hfg_{F12}$$

and $h_{Fl}$=enthalpy of superheated freon leaving the evaporator

Coefficient of performance (COP)

$$COP=\dot{Q}_{REF}/¶$$

when adjusted to be free of units.

Power required

The quantity ($h_p$/ton) is also an interesting quantity and is calculated as follows:

$$H_p/\text{ton}=¶\cdot/\dot{Q}_{REF},$$

where units on right side are horsepower and tons for power and refrigeration, respectively.

In summary of the mathematical model described above, the performance values do not consider pump efficiency or air circulating fan power; however, these efficiencies are simple to incorporate by simple manual calculation. All other real world inefficiences are accounted for with the level of the idealization given in the introduction to the mathematical analysis.

Figure 5:
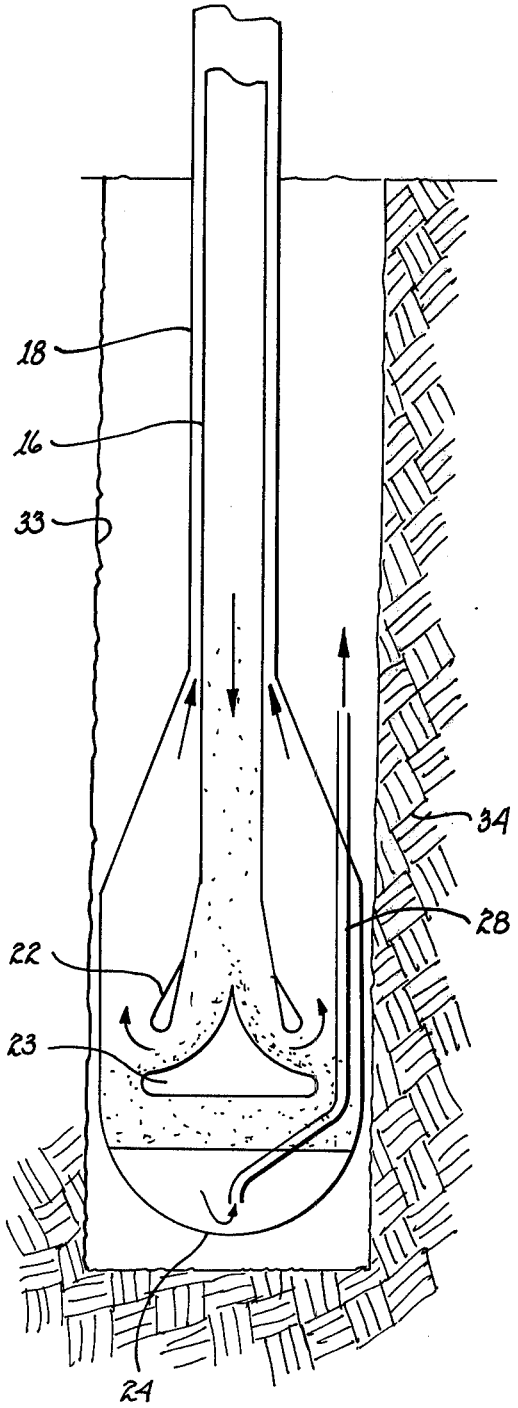
FIG. 5 is a variant of the down pipe and return pipe construction.

A variant of a part of the present invention is illustrated in FIG. 5. Herein, the return pipe is configured concentric with the down pipe and the separation chamber is a bulbous lower end of the return pipe.

In particular, the lower end of down pipe 16 includes a radially expanded skirt 22 to accommodate a partially inserted cone-like flow director 23. The lower end of return pipe 18 includes a bulbous chamber 24 for receiving the lower end of the down pipe and the flow director. The lower end of pipe 28 is disposed at the bottom of bulbous chamber 24. The unit described above may be lodged within a shaft 33 in earth 34.

In operation, the water and entrained freon flow downwardly through the down pipe until it becomes radially dispersed by the flow direction. The radial dispension, in combination with the baffle-like operation of the flow director, tends to still the flow rate and urge separation of the liquid freon from the water. The liquid freon will settle at the bottom of the bulbous chamber; therefrom, it will be drawn off through pipe 28. The separated water will flow upward through the annular passageway defined by down pipe 16 and return pipe 18.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. Apparatus for compressing and withdrawing heat from the refrigerant fluid in a refrigeration system, which refrigeration system includes an expansion valve and an evaporator, said apparatus comprising in combination:

a. a down pipe, including a plenum disposed at the upper end thereof, for conveying the refrigerant fluid downwardly;
b. a fluid non-miscible with the refrigerant fluid;
c. means for introducing the non-miscible fluid into said down pipe and urge downward flow therethrough;
d. means for conveying the refrigerant fluid from the evaporator to said down pipe;
e. means for entraining the refrigerant fluid within the non-miscible fluid flowing downwardly through said down pipe to convey the refrigerant fluid downwardly and compress the refrigerant fluid by the head of the non-miscible fluid;
f. a separation chamber disposed at the lower end of said down pipe for receiving and segregating the refrigerant fluid and the non-miscible fluid;
g. pipe means for withdrawing the refrigerant fluid from said separation chamber and conveying it to the expansion valve;
h. further pipe means for withdrawing the non-miscible fluid from said separation chamber; and
i. heat sink means for dissipating heat from the non-miscible fluid;

whereby, heat is withdrawn from the refrigerant fluid and the non-miscible fluid simultaneous with compression of the refrigerant fluid during downward flow thereof through said down pipe.

2. The apparatus as set forth in claim 1 wherein said entraining means includes an outlet disposed within and subjected to the flow forces attendant the flowing non-miscible fluid.

3. The apparatus as set forth in claim 2 wherein said outlet is disposed within said down pipe.

4. The apparatus as set forth in claim 3 wherein said separation chamber includes means for stilling the flow therethrough.

5. The apparatus as set forth in claim 4 wherein said further pipe means includes a pump for pumping the non-miscible fluid from said separation chamber to said introducing means.

6. The apparatus as set forth in claim 5 wherein the refrigerant fluid comprises freon and the non-miscible fluid comprises water.

7. The apparatus as set forth in claim 1 wherein said further pipe means comprises a concentric pipe disposed about said down pipe.

8. The apparatus as set forth in claim 7 wherein said separation chamber comprises a closed end portion of said concentric pipe disposed beneath the lower end of said down pipe.

9. In a refrigeration system having an expansion valve, an evaporator, a refrigerant fluid and a fluid non-miscible with the refrigerant fluid, the improvement comprising in combination:

a. a down pipe for conveying the refrigerant fluid and the non-miscible fluid downwardly and increasing the pressure thereof at any point in proportion to the depth of the point within said down pipe;

b. a plenum disposed at the upper end of said down pipe for introducing the non-miscible fluid to said down pipe and urging a downward flow through said down pipe;

c. means for conveying the refrigerant fluid from the evaporator to said down pipe and entraining the refrigerant fluid within the downwardly flowing non-miscible fluid;

d. a separation chamber disposed at the lower end of said down pipe for receiving the downwardly flowing refrigerant fluid and the non-miscible fluid and segregating the refrigerant fluid from the non-miscible fluid;

e. means for withdrawing the non-miscible fluid from said separation chamber;

f. means for conveying the refrigerant fluid from said separation chamber to the expansion valve; and g. heat sink means for dissipating the heat introduced to the non-miscible fluid by the refrigerant fluid;

whereby, the compression and heat dissipation of the refrigerant fluid necessary in a refrigeration system is effected by entrainment of the refrigerant fluid within the downwardly flowing non-miscible fluid.

10. The improvement as set forth in claim 9 wherein said conveying and entraining means includes an outlet disposed within and subject to the flow forces attendant the flowing non-miscible fluid.

11. The improvement as set forth in claim 10 wherein said outlet is disposed within said down pipe.

12. The improvement as set forth in claim 11 wherein said separation chamber includes means for stilling the flow therethrough.

13. The improvement as set forth in claim 12 wherein said withdrawing means includes pump means for transporting the non-miscible fluid to said plenum.

14. The improvement as set forth in claim 13 wherein the refrigerant fluid is freon and the non-miscible fluid is water.

15. The improvement as set forth in claim 9 wherein said withdrawing means comprises a concentric pipe about said down pipe.

16. The improvement as set forth in claim 15 wherein said separation chamber comprises a closed end portion of said concentric pipe disposed beneath the lower end of said down pipe.

17. A method for compressing and withdrawing heat from a refrigerant fluid within a refrigeration system having an evaporator and an expansion valve, said method comprising the steps of:

a. establishing a downward flow of a fluid non-miscible with the refrigerant fluid within a down pipe;

b. conveying the refrigerant fluid from the evaporator to the upper end of the down pipe;

c. entraining the refrigerant fluid within the downward flow of the non-miscible fluid;

d. separating the refrigerant fluid from the non-miscible fluid at the lower end of the down pipe;

e. transmitting the separated refrigerant fluid from the lower end of the down pipe to the expansion valve; and f. dissipating heat from the refrigerant fluid within the down pipe;

whereby, the compression and heat dissipation phases of the refrigeration cycle are performed within the down pipe.

18. The method as set forth in claim 17 including the step of drawing and pumping the non-miscible fluid from the lower end of the down pipe to the upper end of the down pipe.

* * * * *